United States Patent [19]

Hisamoto et al.

[11] 4,378,303

[45] Mar. 29, 1983

[54] AZEOTROPIC SOLVENT COMPOSITION

[75] Inventors: Iwao Hisamoto, Suita; Chiaki Maeda, Kyoto; Yukio Omure, Takatsuki, all of Japan

[73] Assignee: Daikin Kogyo Co., Ltd., Japan

[21] Appl. No.: 253,390

[22] Filed: Apr. 13, 1981

[30] Foreign Application Priority Data

| | | | |
|---|---|---|---|
| Apr. 14, 1980 | [JP] | Japan | 55/50027 |
| Apr. 17, 1980 | [JP] | Japan | 55/51360 |
| May 29, 1980 | [JP] | Japan | 55/72616 |

[51] Int. Cl.[3] ..... B01F 1/00; C23G 5/02

[52] U.S. Cl. ..... 252/364; 252/DIG. 9; 252/170; 252/171; 570/110; 570/118

[58] Field of Search ..... 252/364, DIG. 9, 170, 252/171; 570/110, 118

[56] References Cited

U.S. PATENT DOCUMENTS

| | | | |
|---|---|---|---|
| 3,527,708 | 9/1970 | Clark et al. | 252/364 |
| 3,630,926 | 12/1971 | Haase et al. | 252/364 |
| 3,634,274 | 1/1972 | Barton et al. | 570/110 |
| 3,686,130 | 8/1972 | Barton et al. | 570/110 |
| 3,960,746 | 6/1976 | Gorski | 570/110 |

FOREIGN PATENT DOCUMENTS 53-1232 of 1978 Japan .

*Primary Examiner*—Allan Lieberman

*Attorney, Agent, or Firm*—Larson and Taylor

[57] ABSTRACT

An azeotropic solvent composition comprising about 64.6 to 89.0% by weight of tetrachlorodifluoroethane, about 3.7 to 34.2% by weight of an alcohol having carbon atoms of 1 to 5 and about 1.2 to 7.3% by weight of nitroethane.

9 Claims, No Drawings

AZEOTROPIC SOLVENT COMPOSITION

This invention relates to an azeotropic solvent composition, and more particularly to an azeotropic solvent composition comprising tetrachlorodifluoroethane and an alcohol.

Chlorofluoroethanes as solvents (hereinafter referred to as "Flon type solvents") have many advantages. For example, the Flon type solvents not only are nonflammable and low in toxicity but also have excellent selective dissolving power such that when used for washing articles composed of macromolecular substances such as rubbers and plastics, they dissolve fats, greases, oils and like contaminants without causing any damage to the articles.

For the purpose of removing high-melting rosin fluxes from printed circuit substrates in the field of electronic industry or of removing high-melting greases, facts, oils or like contaminants by washing, it is recently desired to provide relatively high-boiling Flon type solvents which are chemically stable and safe.

Among Flon type solvents, trichlorotrifluoroethane may be the best one from the viewpoint of chemical stability and convenience in handling. However, its dissolving power for greases, fats or oils is not fully satisfactory. Moreover, it has a boiling point of as low as 47.6° C. Therefore, it essentially fails to satisfy the above-mentioned requirements.

On the other hand, tetrachlorodifluoroethane is superior in dissolving power for greases, fats and oils to trichlorotrifluoroethane, has a higher boiling point (92.8° C.), and thus is capable of dissolving the above-mentioned high-melting contaminants. However, its insufficient chemical stability and high melting point (26.0° C.) disadvantageously limits the scope of use thereof.

For lowering the melting point of tetrachlorodifluoroethane (hereinafter referred to as "Flon-112"), it has been widely proposed to use Flon-112 in combination with a variety of other solvents. Generally, however, the solvents used in combination with Flon-112 have a tendency to impair the above mentioned useful properties or chemical stability of Flon-112 or fail to form azeotropic composition, and the therefore are not practically usable.

As the most advantageous method of improving the chemical stability of Flon-112 and lowering the melting point thereof, it is known to use an azeotropic solvent composition consisting of Flon-112, an alcohol and nitromethane (Japanese Published Examined Patent Application No. 1232/1978). However, this azeotropic composition contains nitromethane in an amount excessively larger than the amount required for stabilizing Flon-112, and consequently has the drawback of having a tendency to corrode materials to be washed, such as rubbers and plastics. Further the composition is high in toxicity and cost and is disadvantageous.

An object of the invention is to provide an azeotropic solvent composition with which the above-mentioned disadvantages of tetrachlorodifluoroethane can be overcome without impairing the characteristic features thereof as a solvent.

Another object is to provide an azeotropic solvent composition which has an excellent dissolving power originating from tetrachlorodifluoroethane, a low melting point, a good chemical stability and substantially no toxicity.

These and other objects and features of the invention will become more evident from the description which follows.

The azeotropic solvent composition of the present invention comprises 64.6–89.0% by weight of tetrachlorodifluoroethane, 3.7–34.2% by weight of an alcohol selected from the group consisting of ethyl alcohol, propyl alcohols, butyl alcohols and tert-amyl alcohol, and 0.4–7.3% by weight of nitroethane.

The term "tetrachlorodifluoroethane" used herein includes 1,1,2,2-tetrachloro-1,2-difluoroethane and a mixture thereof with an isomer thereof, namely 1,1,1,2-tetrachloro-2,2-difluoroethane. Said mixture contains 1,1,1,2-tetrachloro-2,2-difluoroethane in an amount of about 5 to 10% by weight.

The alcohol to be used in the invention includes ethyl alcohol, propyl alcohol, butyl alcohol and tert-amyl alcohol. Said propyl alcohol includes n-propyl alcohol and iso-propyl alcohol, and said butyl alcohol includes n-butyl alcohol, iso-butyl alcohol, sec-butyl alcohol and tert-butyl alcohol. Among amyl alcohols, tert-amyl alcohol alone is usable; other isomeric amyl alcohols are not usable.

The compositions and physical properties of several examples of the azeotropic solvent composition of the invention are shown in Table 1. For comparison, some compositions known in the art where nitromethane is used in place of nitroethane are also shown.

TABLE 1

| Composition | Amount (wt. %) | B.P. (°C.) | M.P. (°C.) | Note |
|---|---|---|---|---|
| Flon-112 | 75.2 | | | |
| Ethyl alcohol | 24.4 | 71.5 | −0.8 | The present invention |
| Nitroethane | 0.4 | | | |
| Flon-112 | 83.1 | | | |
| n-Propyl alcohol | 13.7 | 83.0 | 1.4 | The present invention |
| Nitroethane | 3.2 | | | |
| Flon-112 | 71.6 | | | |
| iso-Propyl alcohol | 27.2 | 75.9 | −10.1 | The present invention |
| Nitroethane | 1.2 | | | |
| Flon-112 | 89.0 | | | |
| n-Butyl alcohol | 3.7 | 89.0 | 3.0 | The present invention |
| Nitroethane | 7.3 | | | |
| Flon-112 | 85.0 | | | |
| iso-Butyl alcohol | 8.9 | 87.3 | −0.2 | The present invention |
| Nitroethane | 6.1 | | | |
| Flon-112 | 82.5 | | | |
| sec-Butyl alcohol | 13.0 | 86.0 | −4.2 | The present invention |
| Nitroethane | 4.5 | | | |
| Flon-112 | 64.6 | | | |
| tert-Butyl alcohol | 34.2 | 78.2 | 5.6 | The present invention |
| Nitroethane | 1.2 | | | |
| Flon-112 | 84.8 | | | |
| tert-Amyl alcohol | 8.5 | 88.7 | −2.6 | The present invention |
| Nitroethane | 6.7 | | | |
| Flon-112 | 68.4 | | | |
| Ethyl alcohol | 23.1 | 77.5 | −10.9 | Known composition |
| Nitromethane | 8.5 | | | |
| Flon-112 | 76.6 | | | |
| n-Propyl alcohol | 9.6 | 79.1 | −1.7 | Known composition |
| Nitromethane | 13.7 | | | |
| Flon-112 | 66.4 | | | |
| iso-Propyl alcohol | 23.7 | 74.5 | −17.2 | Known composition |
| Nitromethane | 9.9 | | | |
| Flon-112 | 82.1 | | | |
| n-Butyl alcohol | 0.3 | 81.6 | 10.0 | Known composition |
| Nitromethane | 17.6 | | | |
| Flon-112 | 80.8 | | | |
| iso-Butyl alcohol | 2.8 | 81.3 | −8.0 | Known composition |
| Nitromethane | 16.4 | | | |
| Flon-112 | 77.8 | | | |
| sec-Butyl alcohol | 6.4 | 81.0 | −0.8 | Known composition |
| Nitromethane | 15.8 | | | |
| Flon-112 | 62.4 | | | |
| tert-Butyl alcohol | 26.2 | 76.6 | −6.2 | Known composition |
| Nitromethane | 11.4 | | | |

TABLE 1-continued

| Composition | Amount (wt. %) | B.P. (°C.) | M.P. (°C.) | Note |
|---|---|---|---|---|
| Flon-112 | 82.4 | | | |
| tert-Amyl alcohol | 1.0 | 81.2 | — | Known |
| Nitromethane | 16.6 | | | composition |

The present invention thus provides a solvent composition which is chemically stable, low in toxicity and capable of removing high-melting rosin fluxes on printed circuit substrates as well as other high-melting greases or fats or oils by washing therewith. Since the amount of nitroethane is relatively small, the solvent exerts little influence upon the materials to be washed therewith and is also advantageous with respect to toxicity and cost. Furthermore, the composition in accordance with the present invention forms an azeotropic composition, and therefore its handling in the use thereof as well as its recovery for reuse is very easy. If prepared by using ter-amyl alcohol, ethyl alcohol or propyl alcohol as the alcohol component, the compositions of the present invention due to a relatively high content of Flon-112 are very effective especially in washing articles of plastics which are low in resistance to usual solvents. When prepared by using alcohols having 4 carbon atoms which are excellent as the solvent, the compositions of the present invention are less likely to damage the articles to be washed, and thus have an enhanced dissolving power.

The azeotropic composition of the invention can be prepared by mixing the necessary components in the proportions specified in Table 1 in an arbitrary order or by distilling an arbitrary mixture of the required components.

The azeotropic solvent composition of the invention can be used widely and efficiently in removing fluxes from print substrates, cleaning frames of spectacles which have been subjected to a polishing process, washing articles cut with the use of cutting oils, and so on.

The following examples and experiments will illustrate the azeotropic solvent composition of the present invention in more detail.

EXAMPLE 1

Into a distillation flask is charged 500 g of a solvent mixture having the composition specified in Table 2, and distillation was performed at an atmospheric pressure using a rectification column with a number of theoretical plates of 30.

TABLE 2

| Composition | Proportion (wt. %) |
|---|---|
| Flon-112 (92.8° C.) | 50 |
| Ethyl alcohol (78.3° C.) | 40 |
| Nitroethane (114.0° C.) | 10 |

The minimum azeotropic point is 88.7° C. The distillate, when analyzed by gas chromatography, has the composition as shown in Table 1.

EXAMPLES 2–8

The minimum azeotropic point is measured by the same manner as in Example 1 except that the alcohol specified in Table 3 is used in place of ethyl alcohol. The distillate has the composition as shown in Table 1.

TABLE 3

| Example No. | Alcohol used |
|---|---|
| 2 | n-Propyl alcohol |
| 3 | iso-Propyl alcohol |
| 4 | n-Butyl alcohol |
| 5 | iso-Butyl alcohol |
| 6 | sec-Butyl alcohol |
| 7 | tert-Butyl alcohol |
| 8 | tert-Amyl alcohol |

EXPERIMENT 1

For evaluating the azeotropic solvent composition obtained in Example 1 for its adaptability in removing fluxes by washing, an experiment is carried out. Thus, a preflux shown in the table below is applied to the whole surface of a print substrate (60 mm×50 mm) made of a copper-plated phenolic resin laminate followed by application of a postflux shown in the table below. Baking is then carried out at about 250° C. for 2 minutes.

The substrate is cooled to room temperature and thereafter immersed in 300 ml of the above-mentioned solvent composition in a beaker for one minute.

The degree of removal of the fluxes is observed with the unaided eye. The results are shown below.

| Flux | Results of observation |
|---|---|
| Preflux | Removal entirely |
| Postflux | " |

The same experiment is carried out using the compositions obtained in Examples 2 to 8. The same results are obtained.

EXPERIMENT 2

For testing the azeotropic solvent composition obtained in Example 1 for noncorrosivity with respect to a plastic material washed therewith, the following experiment is carried out.

One end portion of a frame for spectacles, which is made of acetylcellulose, is immersed in 200 ml of the above-mentioned solvent composition in a beaker at room temperature for 5 minutes.

The immersed portion is observed by the unaided eye. The results obtained are shown below.

| | Composition | (wt. %) | Results of observation |
|---|---|---|---|
| The present invention | Flon-112 | 75.2 | No change |
| | Ethyl alcohol | 24.4 | |
| | Nitroethane | 0.4 | |
| Prior art | Flon-112 | 68.4 | Swelling of the immersed portion was significant, and a distinct shift was observed between the immersed and unimmersed portions. |
| | Ethyl alcohol | 23.1 | |
| | Nitromethane | 8.5 | |

The same experiments are conducted to the compositions of Examples 2 to 8. The compositions give the same results.

EXPERIMENT 3

The following experiment is performed for demonstrating that each of the azeotropic solvent composition obtained in Examples 5 and 6 is highly effective in removing an abrasive agent without impairing a plastic material washed therewith.

A white stick (a kneaded and shaped mixture of alumina, silica sand and other ingredients with a fat) is applied to the cloth surface of a conventional buffing machine, and a frame for spectacles, which is made of acetylcellulose, is polished. The frame with the abrasive attaching thereto is immersed in the solvent composition specified in the table below and subjected to ultrasonic cleaning (28 KHz, 600 W) for 3 minutes, followed by rinsing with the pure solvent composition for 30 seconds, and observed for the degree of removal of the abrasive and possible influence on the frame material. For comparison, azeotropic compositions containing nitromethane in place of nitroethane or methyl alcohol in place of butyl alcohol are also tested in the same manner.

| | | Azeotropic composition | Wt. % | Results of observation |
|---|---|---|---|---|
| The invention | (1) | Flon-112 | 85.0 | The abrasive is removed, and the frame is well finished and lustrous. |
| | | iso-Butyl alcohol | 8.9 | |
| | | Nitroethane | 6.1 | |
| | (2) | Flon-112 | 82.5 | The abrasive is removed and the frame is well finished and lustrous. |
| | | sec-Butyl alcohol | 13.0 | |
| | | Nitroethane | 4.5 | |
| For comparison | (3) | Flon-112 | 80.8 | The abrasive remains partly, and the frame was slightly swollen. |
| | | iso-Butyl alcohol | 2.8 | |
| | | Nitromethane | 16.4 | |
| | (4) | Flon-112 | 77.8 | The abrasive is removed, but the frame was slightly swollen. |
| | | sec-Butyl alcohol | 6.4 | |
| | | Nitromethane | 15.8 | |
| | (5) | Flon-112 | 72.2 | The abrasive remains partly and the frame is rather poor in luster. |
| | | Methyl alcohol | 27.6 | |
| | | Nitroethane | 0.2 | |

The compositions obtained in Examples 1 to 4 and 7 to 8 are subjected to the same experiment as experiment 3. The results are similar to those of Examples 5 to 6.

We claim:

1. An azeotropic solvent composition comprising
(a) about 64.6 to 89.0% by weight of 1,1,2,2-tetrachloro-1,2-difluoroethane or a mixture of 1,1,2,2-tetrachloro-1,2-difluoroethane and an isomer thereof,
(b) about 3.7 to 34.2% by weight of an alcohol selected from the group consisting of ethyl alcohol, n-propyl alcohol, iso-propyl alcohol, n-butyl alcohol, iso-butyl alcohol, sec-butyl alcohol, tert-butyl alcohol and tert-amyl alcohol,
(c) about 0.4 to 7.3% by weight of nitroethane.

2. The azeotropic solvent composition according to claim 1 in which said composition consists essentially of about 84.8% by weight of 1,1,2,2-tetrachloro-1,2-difluoroethane or a mixture of 1,1,2,2-tetrachloro-1,2-difluoroethane and an isomer thereof, about 8.5% by weight of tert-amyl alcohol and about 6.7% by weight of nitroethane.

3. The azeotropic solvent composition according to claim 1 in which said composition consists essentially of about 75.2% by weight of 1,1,2,2-tetrachloro-1,2-difluoroethane or a mixture of 1,1,2,2-tetrachloro-1,2-difluoroethane and an isomer thereof, about 24.4% by weight of ethyl alcohol and about 0.4% by weight of nitroethane.

4. The azeotropic solvent composition according to claim 1 in which said composition consists essentially of about 83.1% by weight of 1,1,2,2-tetrachloro-1,2-difluoroethane or a mixture of 1,1,2,2-tetrachloro-1,2-difluoroethane and an isomer thereof, about 13.7% by weight of n-propyl alcohol and about 3.2% by weight of nitroethane.

5. The azeotropic solvent composition according to claim 1 in which said composition consists essentially of about 71.6% by weight of 1,1,2,2-tetrachloro-1,2-difluoroethane or a mixture of 1,1,2,2-tetrachloro-1,2-difluoroethane and an isomer thereof, about 27.2% by weight of iso-propyl alcohol and about 1.2% by weight of nitroethane.

6. The azeotropic solvent composition according to claim 1 in which said composition consists essentially of about 89.0% by weight of 1,1,2,2-tetrachloro-1,2-difluoroethane or a mixture of 1,1,2,2-tetrachloro-1,2-difluoroethane and an isomer thereof, about 3.7% by weight of n-butyl alcohol and about 7.3% by weight of nitroethane.

7. The azeotropic solvent composition according to claim 1 in which said composition consists essentially of about 85.0% by weight of 1,1,2,2-tetrachloro-1,2-difluoroethane or a mixture of 1,1,2,2-tetrachloro-1,2-difluoroethane and an isomer thereof, about 6.1% by weight of iso-butyl alcohol and about 8.9% by weight of nitroethane.

8. The azeotropic solvent composition according to claim 1 in which said composition consists essentially of about 82.5% by weight of 1,1,2,2-tetrachloro-1,2-difluoroethane or a mixture of 1,1,2,2-tetrachloro-1,2-difluoroethane and an isomer thereof, about 13.0% by weight of sec-butyl alcohol and about 4.5% by weight of nitroethane.

9. The azeotropic solvent composition according to claim 1 in which said composition consists essentially of about 64.6% by weight of 1,1,2,2-tetrachloro-1,2-difluoroethane or a mixture of 1,1,2,2-tetrachloro-1,2-difluoroethane and an isomer thereof, about 34.2% by weight of tert-butyl alcohol and about 1.2% by weight of nitroethane.

* * * * *